US009080387B2

(12) United States Patent
Schulte et al.

(10) Patent No.: US 9,080,387 B2
(45) Date of Patent: Jul. 14, 2015

(54) DIRECTIONAL WELLBORE CONTROL BY PILOT HOLE GUIDANCE

(75) Inventors: Philip Christof Schulte, Burgwedel (DE); Hans Robert Oppelaar, Lower Saxony (DE); Michael Koppe, Niedersachsen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 1007 days.

(21) Appl. No.: 13/196,555

(22) Filed: Aug. 2, 2011

(65) Prior Publication Data

US 2012/0031677 A1 Feb. 9, 2012

Related U.S. Application Data

(60) Provisional application No. 61/370,257, filed on Aug. 3, 2010.

(51) Int. Cl.
*E21B 7/06* (2006.01)

(52) U.S. Cl.
CPC .. *E21B 7/064* (2013.01); *E21B 7/06* (2013.01)

(58) Field of Classification Search
CPC ..... E21B 10/62; E21B 10/26; E21B 7/064; E21B 10/40
USPC ..... 175/61, 108, 257, 382, 386, 75
See application file for complete search history.

(56) References Cited

U.S. PATENT DOCUMENTS 2,227,233 A * 12/1940 Noble et al. ..... 175/80
4,106,577 A 8/1978 Summers
4,307,786 A 12/1981 Evans
4,386,669 A 6/1983 Evans
5,052,503 A 10/1991 Löf
5,150,755 A 9/1992 Cassel et al.
5,361,859 A 11/1994 Tibbitts
5,529,133 A * 6/1996 Eddison ..... 175/61
5,560,440 A 10/1996 Tibbitts
5,568,838 A 10/1996 Struthers et al.
6,131,675 A 10/2000 Anderson
6,390,211 B1 5/2002 Tibbitts
6,880,648 B2 4/2005 Edscer
7,198,119 B1 4/2007 Hall et al.
7,207,398 B2 * 4/2007 Runia et al. ..... 175/61
7,225,886 B1 6/2007 Hall
7,258,179 B2 8/2007 Hall
7,270,196 B2 9/2007 Hall
7,296,639 B2 * 11/2007 Millar et al. ..... 175/57
7,328,755 B2 2/2008 Hall et al.
7,419,016 B2 9/2008 Hall et al.
7,464,774 B2 12/2008 Savignat et al.
7,624,824 B2 12/2009 Hall et al.
7,694,756 B2 4/2010 Hall et al.
8,201,642 B2 * 6/2012 Radford et al. ..... 175/262

(Continued)

FOREIGN PATENT DOCUMENTS

WO WO 2009/101476 A2 8/2009

*Primary Examiner* — Jennifer H Gay
*Assistant Examiner* — Steven MacDonald
(74) *Attorney, Agent, or Firm* — Mossman, Kumar & Tyler, PC

(57) ABSTRACT

A directional drilling apparatus include a first cutter that substantially cuts a wellbore bottom along a first axis and a second cutter that cuts the wellbore bottom along a second axis different from the first axis. The second cutter may extend an adjustable amount out of the first cutter. The pilot string may connect the second cutter to the first cutter.

18 Claims, 3 Drawing Sheets

(56) References Cited

U.S. PATENT DOCUMENTS

| | | | | |
|---|---|---|---|---|
| 2003/0213621 | A1 | 11/2003 | Britten et al. | |
| 2004/0238221 | A1 * | 12/2004 | Runia et al. | 175/61 |
| 2006/0118298 | A1 * | 6/2006 | Millar et al. | 166/242.7 |
| 2008/0179098 | A1 * | 7/2008 | Hall et al. | 175/73 |
| 2010/0006341 | A1 | 1/2010 | Downtown | |
| 2010/0181112 | A1 * | 7/2010 | Radford et al. | 175/57 |
| 2013/0264120 | A1 * | 10/2013 | Zhou | 175/61 |

* cited by examiner

DIRECTIONAL WELLBORE CONTROL BY PILOT HOLE GUIDANCE

CROSS REFERENCE TO RELATED APPLICATIONS

This application claims priority from U.S. Provisional Application Ser. No. 61/370,257 filed Aug. 3, 2010, the disclosure of which is incorporated herein by reference in its entirety.

BACKGROUND OF THE DISCLOSURE

1. Field of the Disclosure

This disclosure relates generally to oilfield downhole tools and more particularly to drilling assemblies utilized for directionally drilling wellbores.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of current drilling activity involves drilling deviated and horizontal wellbores to more fully exploit hydrocarbon reservoirs. Such boreholes can have relatively complex well profiles. The present disclosure addresses the need for steering devices for drilling such wellbores, as well as other needs of the prior art.

SUMMARY OF THE DISCLOSURE

In aspects, the present disclosure provides an apparatus for forming a wellbore in a subterranean formation. In one embodiment, the apparatus may include a first cutter configured to substantially cut a wellbore bottom along a first axis; and a second cutter extending an adjustable amount out of the first cutter. The second cutter may be configured to cut the wellbore bottom along a second axis different from the first axis. In another embodiment, the apparatus may include a first cutter configured to substantially cut a wellbore bottom along a first axis; a second cutter that projects from the first cutter and is configured to cut the wellbore bottom along a second axis different from the first axis; and a pilot string connecting the second cutter to the first cutter.

In aspects, the present disclosure also provides a method for forming a wellbore in a subterranean formation. The method may include substantially cutting a wellbore bottom along a first axis using a first cutter; and steering the first cutter using a second cutter that extends an adjustable amount out of the first cutter. In another embodiment, the method may include substantially cutting a wellbore bottom along a first axis using a first cutter; and cutting the wellbore bottom along a second axis different from the first axis using a second cutter connected to the first cutter with a pilot string.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide steering devices that use a steerable pilot string positioned ahead or downhole of a main drill bit or cutter. As used herein, the main cutter or main drill bit is the cutting structure that substantially cuts the wellbore bottom as opposed to a reamer that enlarges a wellbore by cutting a wellbore wall. That is, the main bit may cut more wellbore bottom surface area than the pilot bit. Moreover, the main cutter is positioned at an end of a drill string as opposed to at a location between a distal end and the surface. The main drill bit is guided in a desired direction by the pilot string. The pilot string may include a cutter for breaking up the formation, such as a pilot drill bit or a fluid ejecting nozzle. In embodiments using a pilot drill bit, this pilot drill bit may be rotated using a rotating drill string or a separate motor. The pilot drill bit may be rotated in the same direction or the opposite direction of the main drill bit. Further, the rotational speed of the pilot drill bit may be the same as or different from that of the main drill bit. The pilot drill bit or nozzle may be oriented to form a pilot hole having a direction different from the borehole drilled by the main drill bit. This orientation may be fixed or adjustable. Because the pilot hole formed by the pilot string is smaller than the main bore, the components used to steer the main drill bit are also smaller and more compact. The smaller diameter of the pilot hole also allows the use of lower steering forces to steer the main drill bit. Furthermore, one size of pilot string may be used with main drill bits of different diameters.

Figure 1:
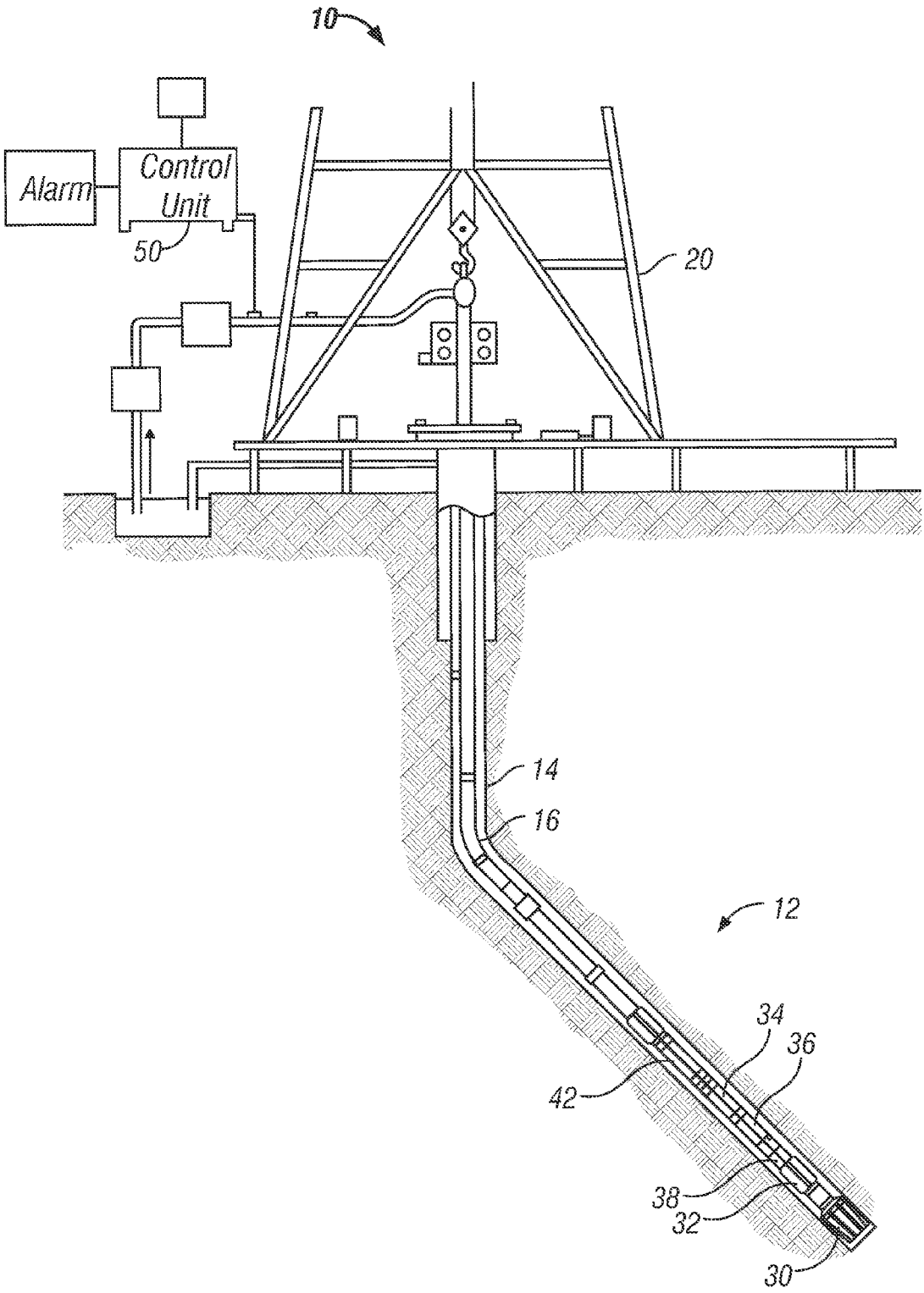
FIG. 1 illustrates a drilling system made in accordance with one embodiment of the present disclosure.

Referring now to FIG. 1, there is shown one illustrative embodiment of a drilling system 10 utilizing a steerable drilling assembly or bottomhole assembly (BHA) 12 for directionally drilling a wellbore 14. While a land-based rig is shown, these concepts and the methods are equally applicable to offshore drilling systems. The system 10 may include a drill string 16 suspended from a rig 20 that conveys the BHA 12 into the wellbore 14. The drill string 16, which may be jointed tubulars or coiled tubing, may include power and/or data conductors such as wires for providing bidirectional communication and power transmission. In one configuration, the BHA 12 includes a steerable assembly 30, a sensor sub 32, a bidirectional communication and power module (BCPM) 34, a formation evaluation (FE) sub 36, and rotary power devices such as motors 38. Merely for convenience, one motor 38 is shown. However, it should be understood that the feature 38 may include several motors, each of which may operate independently or cooperatively. Exemplary motors include, but are not limited to, electric motors, hydraulic motors, turbines, etc. The system may also include information processing devices such as a surface controller 50 and/or a downhole controller 42.

Figure 2:
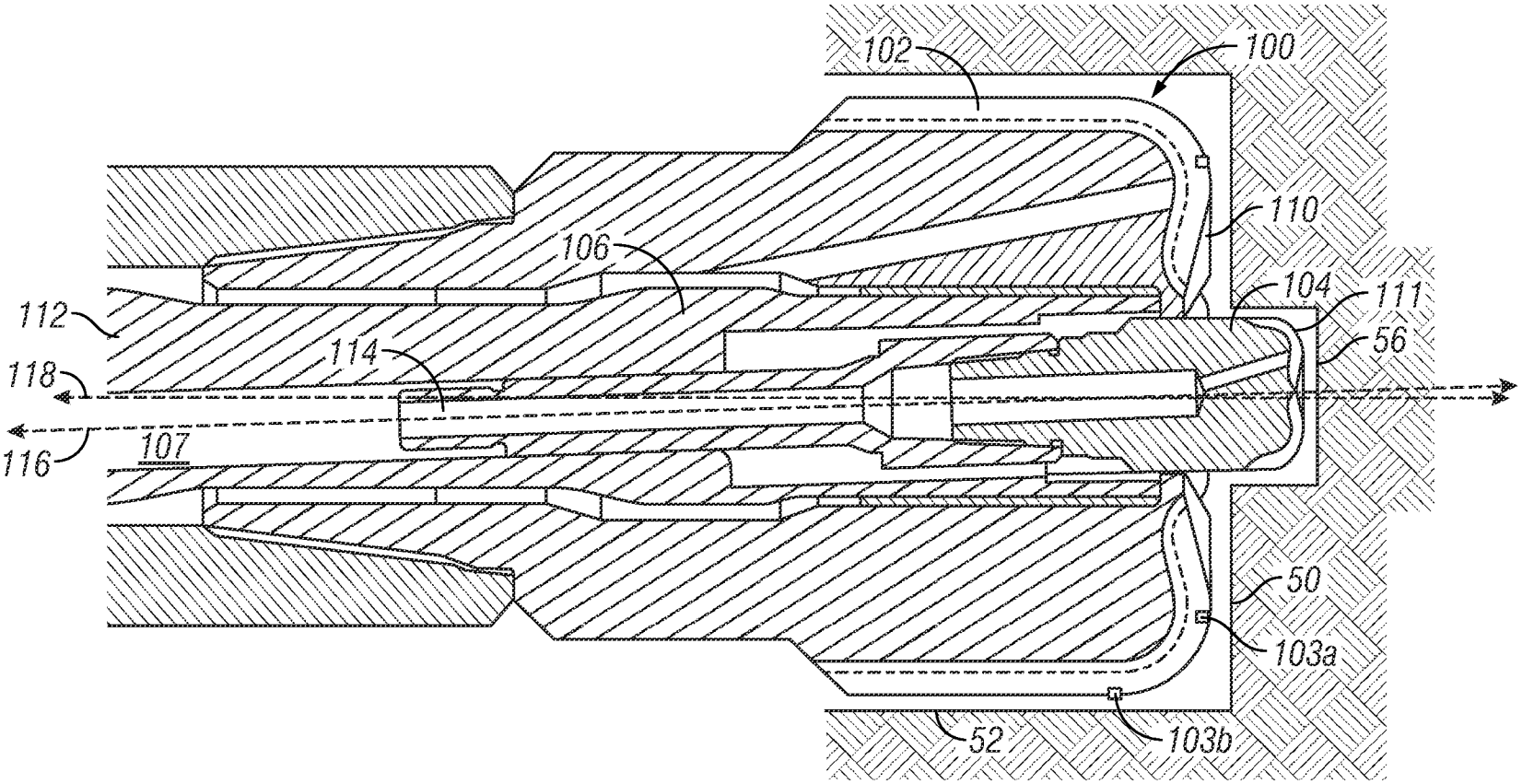
FIG. 2 schematically illustrates a steering device made in accordance with one embodiment of the present disclosure that uses a pilot drill bit.

FIG. 2 schematically illustrates one steerable assembly 100 for directionally drilling a borehole in a subterranean formation. The steerable assembly 100 includes a main drill bit 102, a pilot drill bit 104, and a pilot drill bit orientation device 106. The main drill bit 102 (or "main cutter") may have cutting elements 103*a* positioned on a bit face 110 that engage a wellbore bottom 50 and side cutting elements 103*b* positioned to engage a wellbore side 52. The main drill bit 102 may be rotated by rotating the drill string 16 (FIG. 1) and/or a drilling motor 38 (FIG. 1).

The pilot drill bit 104 (or "pilot cutter") is configured to form a pilot hole 56 in the wellbore bottom 50. The pilot drill bit 104 may include fluid nozzles 152 (FIG. 4) that direct drilling fluid onto the interface between the pilot drill bit 104 and the wellbore bottom 50. The pilot drill bit orientation device 106 may include a body 112 that may be formed as a tube or sleeve. The body 112 includes a passage 114 for receiving the pilot drill bit 104. The passage 114 has a longitudinal axis 116 that is non-parallel to the longitudinal axis 118 of the main drill bit 102. As will be described below, the angular deviation between the axes 116 and 118 allows the pilot drill bit 104 to alter a direction of drilling of the main drill bit.

In one embodiment, the pilot drill bit 104 may project out of the main drill bit 102 along the axis 116. Thus, the pilot hole 56 formed by the pilot drill bit 104 will have an orientation (e.g., inclination, azimuth, etc.) that is the same as the axis 116 and, therefore, different from the bore formed by the main drill bit 102, which is aligned with the axis 118. The steering forces generated by the pilot drill bit 104 as the pilot drill bit 104 progresses through the pilot hole 56 causes the main drill bit 102 to alter drilling direction at a specified build-up rate (BUR). It should be appreciated that these steering forces are being generated "ahead of" or downhole of the main drill bit 102 and in a bore having a smaller diameter than the bore being drilled by the main drill bit 102.

In some embodiments, the pilot drill bit 104 may be configured to adjust the amount of BUR. For example, the pilot drill bit 104 may extend out of and/or retract into the main drill bit 102. For example, the pilot drill bit 104 may have a first position wherein the pilot drill bit 104 is retracted into the main drill bit 102 such that the pilot drill bit 104 does not alter the drilling direction of the main drill bit 102 to any meaningful degree. The pilot drill bit 104 may have a second position wherein the pilot drill bit 104 is extended out of the main drill bit 102 to provide a maximum amount of deviation (BUR) to the drilling direction of the main drill bit 102. Moreover, the pilot drill bit 104 may be positioned at one or more intermediate positions between the first position and the second position to provide a proportionate amount of deviation or BUR to the drilling direction. Any number of devices may be used to translate the pilot drill bit 104. For instance, a motor, which may be electrically or hydraulically energized, in conjunction with a gear assembly may be used. Also, devices such as piston-cylinder arrangement energized by pressurized fluid, devices using biasing members such as springs, solenoids, or other devices may be used to move the pilot drill bit 104 in and out of the main drill bit 102.

In some embodiments, the pilot drill bit 104 may be coupled to and rotate with the main drill bit 102. A suitable torque transmitting connector (not shown) may be used to connect the pilot drill bit 104 and the main drill bit 102. In other embodiments, the pilot drill bit 104 may be rotated with a rotary power source such as an electric motor, mud motor, or other rotary power generator (e.g., motor 38 of FIG. 1). In such embodiments, rotation of the pilot drill bit 104 may be independent of the main drill bit 102: e.g., have a speed that is the same as or different from that of the main drill bit 102 and a rotational direction that is the same as or different from the main drill bit 102.

The pilot drill bit orientation device 106 controls the drilling direction of the pilot drill bit 104. In one arrangement, the pilot drill bit orientation device 106 rotates the body 112 to align the passage 114/axis 116 with a desired drilling direction. To maintain the alignment geostationary during drilling, the orientation device 106 rotates the body 112 at the same speed as the main drill bit 102, but in the opposite direction. Thus, the pilot drill bit 104 becomes substantially "geostationary," i.e., the pilot drill bit 104 points in one azimuthal direction. A motor (e.g., motor 38 of FIG. 1) may be used to rotate the body 112. Also, the pilot drill bit orientation device 106 may include a bore 107 for conveying fluid to the pilot drill bit 104.

In one mode of operation, the azimuthal drilling direction is set by appropriately rotating the body 112. Also, the magnitude of the BUR is set by appropriately extending the pilot drill bit 104 out of the main drill bit 102. Next, the body 112 and the main drill bit 102 are counter—rotated at the same speed to render the pilot drill bit 104 geostationary. Thereafter, drilling may commence. Drilling fluid may be supplied to the main drill bit 102 and the pilot drill bit 104 to wash away cuttings and cool and lubricate the cutting elements. As noted previously, drilling fluid may flow through the bore 107 of the body 112 to the pilot drill bit 104. Also, the rotational position of the body 112 may be adjusted as needed to control drilling direction.

Further, it should be noted that the FIG. 2 embodiment may be configured such that pilot bit 104 does not pivot or tilt within the main bit 102. That is, a bit face 111 of the pilot bit 104 and the bit face 110 of the main bit 102 may remain in generally fixed angular relationship or alignment. Thus, an element such as a universal joint or other similar device that allows the pilot bit 104 to pivot inside the main bit 102 is not necessarily required between the pilot bit 104 and the main bit 102.

Figure 3:
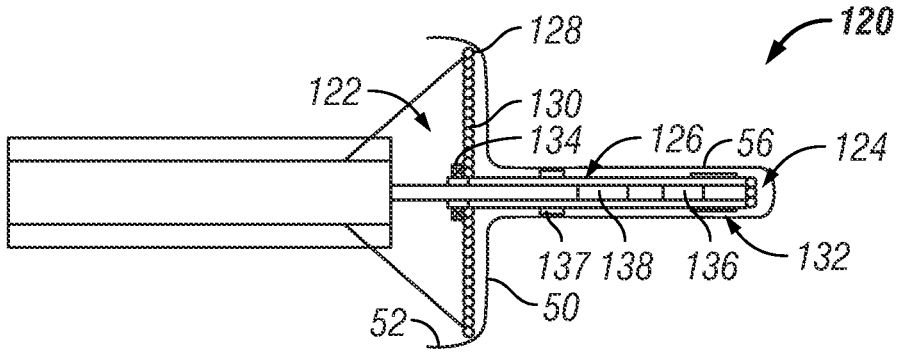
FIG. 3 schematically illustrates another embodiment of a steering device made in accordance with one embodiment of the present disclosure that uses a pilot string provided with a pilot drill bit.

Referring now to FIG. 3, there is shown another steerable assembly 120 for directionally drilling a borehole in a subterranean formation. The bit 120 includes a main drill bit 122, a pilot drill bit 124, and a pilot string 126. The main drill bit 122 may have cutting elements 128 positioned on a bit face 130 that engages the wellbore bottom 50 and may also include side cutting elements (not shown) to engage a wellbore side 52. The main drill bit 122 may be rotated by rotating the drill string 16 (FIG. 1) and/or by using a drilling motor 38 (FIG. 1). The pilot drill bit 124 is configured to form a pilot hole 56 in the wellbore bottom 50. The pilot drill bit 124 is coupled to one end of the pilot string 126. The other end of the pilot string 126 is coupled to the main drill bit 122. The pilot string 126 may include devices such as a stabilizer 137 to absorb reaction forces generated by cutting action of the pilot drill bit 124, reduce lateral and axial vibrations, and provide strength to the pilot string 126.

In one embodiment, a steering device 132 positioned on the pilot string 126 controls the drilling direction of the pilot drill bit 124. In some embodiments, the pilot string 126 may be non-rotating relative to the formation. Suitable steering arrangements may include, but are not limited to, bent subs, drilling motors with bent housings, a pad-type steering devices that apply force to a wellbore wall, "point the bit" steering systems, etc. A bearing or other coupling 134 may connect the pilot string 126 to the main drill bit 122. The coupling 134 may be a rotary coupling that allows the pilot string 126 to remain stationary as the main drill bit 122 rotates. In one embodiment, the pilot drill bit 126 may be rotated by a drilling motor 136 positioned on the pilot string 126. The drilling motor 136 may be energized by pressurized fluid, electrical power, by rotary power generated at a different location, etc. In other embodiments, a motor uphole of the main drill bit 122 (e.g., motor 38 of FIG. 1) may be used to rotate the pilot drill bit 124. It should be appreciated that the steering forces for controlling the main drill bit 122 are generated ahead or downhole of the main drill bit 122.

Referring now to FIGS. 2 and 3, it should be understood that the pilot drill bits 104 and 124, are merely illustrative of cutters that may be used to form the pilot hole 56. For example, in certain embodiments, the pilot cutters may use percussive cutting elements that disintegrate or remove rock by hammering on the wellbore bottom 50. In still other embodiments, the pilot cutters may employ other forms of energy such as electrical energy or acoustical energy to vaporize the formation. The energy for such devices may be transmitted from the surface or may be generated downhole. Thus, the pilot cutters are not limited to merely rotating drill bits. As discussed below, cutters that use high-pressure fluid jets may also be used.

Figure 4:
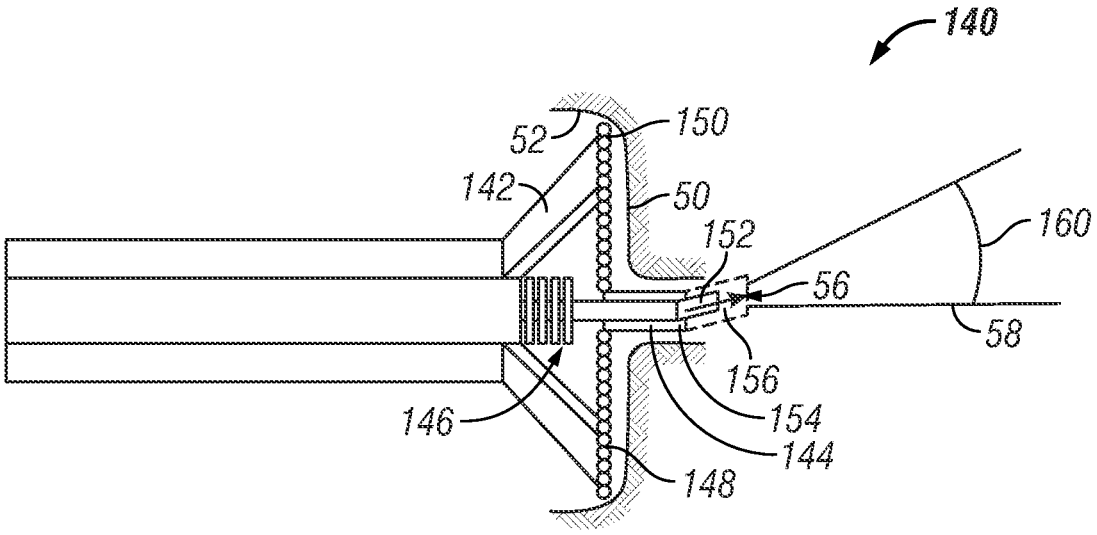
FIG. 4 schematically illustrates yet another steering device made in accordance with one embodiment of the present disclosure that uses fluid cutters.

Referring now to FIG. 4, there is shown yet another steerable assembly 140 for directionally drilling a borehole in a subterranean formation. The steerable assembly 140 includes a main drill bit 142, a pilot member 144, and a fluid source 146. The main drill bit 142 may have cutting elements 148 positioned on a bit face 150 that engage the wellbore bottom 50 and may also include side cutting elements (not shown) to engage a wellbore side 52. In one embodiment, the pilot member 144 may include a nozzle 152 and a nozzle orientation member 154. The fluid source 146 may include a pressure increasing devices such as a pump that supplies fluid at a pressure or velocity sufficient to remove or break-up rock at the wellbore bottom 50. As the rock is broken-up, the pilot member 144 progresses into the pilot hole 56. The pilot member 144 may be a relatively rigid portion, such as a solid nose, that wedges into the pilot hole 56 and causes main drill bit 142 to follow. The fluid source 146 include one or more pressure increasing devices, flow regulation devices such as valves, etc. and may be positioned in the steerable assembly 140 or elsewhere along the drill string.

When desired, the pilot string 144 may direct a high-pressure fluid jet 156 at an angle that forms a pilot hole 56 having a direction (e.g., azimuth and inclination) that is different from the direction of the bore being drilled by the main drill bit 142. In some embodiments, the nozzle 152 may direct the fluid jet 156 at an angle 160 relative to the longitudinal axis 158 of the main drill bit 142. In other embodiments, the angle 160 axis may be adjustable or controllable such that the BUR can be changed while the steering bit 140 is in the wellbore. Thus, the nozzle 152 may have a fixed tilt or have an adjustable tilt. In still another embodiment, the pilot member 144 itself may be oriented as needed to change the direction of the high-pressure fluid jet 156. To maintain the nozzle 152 in a geostationary position, the nozzle orientation member 154 may be counter-rotated by any suitable means (e.g. motor of FIG. 1). The high-pressure fluid jet 156 may also be effectively held geostationary by only supplying the fluid when nozzle 152 is positioned at the desired azimuthal direction. That is, the fluid supply may be pulsed at a frequency that corresponds with the rotation of main drill bit 142. The pulse rate may directly match the rotational speed of the main drill bit 142 (e.g., one pulse per revolution) or be a proportionate correspondence (e.g., one pulse per two or more revolution). It should be appreciated that the steering components ahead of the main drill bit 142 may have few, if any, moving parts.

Referring now to FIGS. 1-4, in an exemplary manner of use, the BHA 12 is conveyed into the wellbore 14 from the rig 20. During drilling of the wellbore 14, the steering device 30 forms the wellbore 14 and steers the drill string 16 in a selected direction. The drilling direction may follow a preset trajectory that is programmed into a surface and/or downhole controller (e.g., controller 50 and/or controller 42). The controller(s) use directional data received from downhole directional sensors to determine the orientation of the BHA 12, compute course correction instructions if needed, and transmit those instructions to the steering device 30.

The BHA 12 may include a variety of sensors and other devices positioned uphole of the main drill bits 102, 122, 142 or downhole of these bits, e.g., on the pilot string 126 or pilot drill bit 124. Illustrative sensors include, but are not limited to: sensors for measuring near-bit direction (e.g., BHA azimuth and inclination, BHA coordinates, etc.), dual rotary azimuthal gamma ray, bore and annular pressure (flow-on & flow-off), temperature, vibration/dynamics, multiple propagation resistivity, and sensors and tools for making rotary directional surveys; sensors for determining parameters of interest relating to the formation, borehole, geophysical characteristics, borehole fluids and boundary conditions; formation evaluation sensors (e.g., resistivity, dielectric constant, water saturation, porosity, density and permeability), sensors for measuring borehole parameters (e.g., borehole size, borehole roughness. true vertical depth, measured depth), sensors for measuring geophysical parameters (e.g., acoustic velocity and acoustic travel time), sensors for measuring borehole fluid parameters (e.g., viscosity, density, clarity, rheology, pH level, and gas, oil and water contents); Such exemplary sensors may include an rpm sensor, a weight on bit sensor, sensors for measuring mud motor parameters (e.g., mud motor stator temperature, differential pressure across a mud motor, and fluid flow rate through a mud motor), and sensors for measuring vibration, whirl, radial displacement, stick-slip, torque, shock, vibration, strain, stress, bending moment, bit bounce, axial thrust, friction and radial thrust. The near bit inclination devices may include three (3) axis accelerometers, gyroscopic devices and signal processing circuitry; and boundary condition sensors, sensors for measuring physical and chemical properties of the borehole fluid.

Illustrative devices include, but are not limited to, the following: one or more memory modules and a battery pack module to store and provide back-up electric power; an information processing device that processes the data collected by the sensors and may transmit appropriate control signals to the steering device 100; a bidirectional data communication and power module ("BCPM") that transmits control signals between the BHA 12 and the surface as well as supplies electrical power to the BHA 12; a mud-driven alternator: a mud pulser; and communication links using hard wires (e.g., electrical conductors, fiber optics), acoustic signals, EM or RF.

From the above, it should be appreciated that what has been described includes, in part, an apparatus for forming a wellbore in a subterranean formation. In one embodiment, the apparatus may include a first cutter that substantially cuts a wellbore bottom along a first axis and a second cutter that extends an adjustable amount out of the first cutter. The second cutter may be configured to cut the wellbore bottom along a second axis different from the first axis. In another embodiment, the apparatus may include a first cutter configured to substantially cut a wellbore bottom along a first axis; a second cutter that projects from the first cutter and is configured to cut the wellbore bottom along a second axis different from the first axis; and a pilot string connecting the second cutter to the first cutter.

From the above, it should be appreciated that what has been described includes, in part, a method for forming a wellbore in a subterranean formation. The method may include substantially cutting a wellbore bottom along a first axis using a first cutter; and steering the first cutter using a second cutter that extends an adjustable amount out of the first cutter. In another embodiment, the method may include substantially cutting a wellbore bottom along a first axis using a first cutter; and cutting the wellbore bottom along a second axis different from the first axis using a second cutter connected to the first cutter with a pilot string.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. An apparatus for forming a wellbore in a subterranean formation, comprising:

a first cutter configured to substantially cut a first section of a wellbore bottom along a first axis;

a second cutter extending an adjustable amount out of the first cutter and rotating to cut a second section of the wellbore bottom different from the first section, the second cutter configured to cut the wellbore bottom along a second axis different from the first axis, the first cutter and the second cutter being arranged to cut the different sections of the wellbore bottom at the same time, the second cutter positioned to cut deeper into the wellbore bottom than the first cutter, wherein the second cutter has a fluid path directing a drilling fluid onto the second section of the wellbore bottom; and a rotary power source rotating the second cutter while the first cutter cuts the first section of the wellbore bottom.

2. The apparatus of claim 1 further comprising an orientation device having a passage for receiving the second cutter, and a motor configured to rotate the orientation device.

3. The apparatus of claim 1, further comprising a rotary power source rotating the second cutter, and wherein the first cutter and the second cutter are connected via a torque transmitting connector transmitting torque from the rotary power source to the second cutter via the torque transmitting connector.

4. The apparatus of claim 1, further comprising a rotary power device coupled to and rotating the second cutter, and wherein the second cutter is configured to rotate independently of the first cutter.

5. The apparatus of claim 4 wherein the rotary power device is configured to counter-rotate the second cutter relative to the first cutter.

6. An apparatus for forming a wellbore in a subterranean formation, comprising:

a first cutter configured to substantially cut a wellbore bottom along a first axis;

a second cutter projecting from the first cutter, the second cutter configured to cut the wellbore bottom along a second axis different from the first axis, the second cutter having a fluid path directing a drilling fluid onto the wellbore bottom; and a pilot string connecting the second cutter to the first cutter.

7. The apparatus of claim 6, further comprising a steering device disposed on the pilot string, wherein the steering device is configured to control a drilling direction of the second cutter; and a rotary power source rotating the second cutter.

8. The apparatus of claim 6, further comprising a motor coupled to the second cutter, the motor being configured to rotate the second cutter relative to the wellbore bottom while the second cutter engages the wellbore bottom.

9. The apparatus of claim 6, wherein the second cutter includes a nozzle configured to direct a fluid against a wellbore bottom.

10. A method for forming a wellbore in a subterranean formation, comprising:

substantially cutting a wellbore bottom along a first axis using a first cutter; and steering the first cutter using a second cutter that extends an adjustable amount out of the first cutter;

counter-rotating the second cutter relative to the first cutter;

cutting the wellbore bottom by rotating the second cutter; and positioning the second cutter deeper into the wellbore bottom than the first cutter while cutting the wellbore bottom with the first cutter.

11. The method of claim 10 further comprising orienting the second cutter relative to the first cutter using an orientation device having a passage for receiving the second cutter, and rotating the orientation device using a motor.

12. The method of claim 10, further comprising transmitting torque between the first cutter and the second cutter using a torque transmitting connector, wherein the torque rotates the second cutter to cut the wellbore bottom while the first cutter cuts the wellbore bottom.

13. The method of claim 10, further comprising varying a build-up rate by varying the amount the second cutter extends from the first cutter.

14. The method of claim 10, further comprising rotating the second cutter independently of the first cutter.

15. A method for forming a wellbore in a subterranean formation, comprising:

substantially cutting a wellbore bottom along a first axis using a first cutter; and cutting the wellbore bottom along a second axis different from the first axis using a second cutter connected to the first cutter with a pilot string; and directing a drilling fluid out of the second cutter.

16. The method of claim 15, further comprising controlling a drilling direction of the second cutter using a steering device disposed on the pilot string.

17. The method of claim 15, further comprising: cutting the wellbore bottom by rotating the second cutter using a motor coupled to the pilot string, wherein the wellbore bottom is being cut by the first cutter and the second cutter at the same time.

18. The method of claim 15, further comprising directing a fluid against a wellbore bottom using a nozzle associated with the second cutter.

* * * * *